US006872060B2

(12) United States Patent
Lin

(10) Patent No.: US 6,872,060 B2
(45) Date of Patent: Mar. 29, 2005

(54) PUMP HAVING A PORT FOR DRAWING AIR OR FLUID

(76) Inventor: Yen Tang Lin, No. 14, Lane 69, Sec. 4, Tien Gin Road, Taichung (TW), 406

( * ) Notice: Subject to any disclaimer, the term of this patent is extended or adjusted under 35 U.S.C. 154(b) by 0 days.

(21) Appl. No.: 09/967,373

(22) Filed: Sep. 26, 2001

(65) Prior Publication Data

US 2003/0059324 A1 Mar. 27, 2003

(51) Int. Cl.[7] ..... F04B 1/00
(52) U.S. Cl. ..... 417/527; 417/53
(58) Field of Search ..... 417/527, 553, 417/526, 260, 53, 404; 222/385; 60/453; 401/150; 137/492.5; 251/31

(56) References Cited

U.S. PATENT DOCUMENTS 3,790,123 A * 2/1974 Grove et al. ..... 251/31
4,242,057 A * 12/1980 Bender ..... 417/404
4,319,603 A * 3/1982 Snyder ..... 137/492.5
4,971,470 A * 11/1990 Moeck et al. ..... 401/150
5,489,197 A * 2/1996 Tsai ..... 417/526
5,507,624 A * 4/1996 Fehn ..... 417/53
5,531,575 A * 7/1996 Lin ..... 417/526
5,638,679 A * 6/1997 Richards ..... 60/453
5,885,061 A * 3/1999 Olofsson et al. ..... 417/260
6,065,947 A * 5/2000 Wu ..... 417/526
6,269,981 B1 * 8/2001 Nielsen ..... 222/385
6,299,420 B1 * 10/2001 Saputo et al. ..... 417/527
6,497,560 B2 * 12/2002 Carlson ..... 417/553

* cited by examiner

*Primary Examiner*—Teresa Walberg
*Assistant Examiner*—Leonid M Fastovsky
(74) *Attorney, Agent, or Firm*—Charles E. Baxley

(57) ABSTRACT

A pump includes a cylinder housing having a mouth for a fluid to flow out of the housing and a port for the fluid to flow into the housing, a piston slidably engaged in the housing. A tube is coupled to the piston for allowing the fluid to flow out through the tube when the piston moves away from the mouth. A check valve may block the tube when the piston moves toward the mouth. Another check valve may block the port when the piston moves toward the port. Another housing includes a mouth for coupling and supplying a pressurized fluid to the previous housing.

19 Claims, 4 Drawing Sheets

PUMP HAVING A PORT FOR DRAWING AIR OR FLUID

BACKGROUND OF THE INVENTION

1. Field of the Invention

The present invention relates to a pump, and more particularly to a pump having a port for drawing air or liquid or the other fluids.

2. Description of the Prior Art

Typical pumps, particularly the hand pumps, include an actuator cylinder housing, a piston slidably engaged in the cylinder housing and movable in the cylinder housing for pumping air in and out of the cylinder housing. The cylinder includes a port coupled to a nozzle for sending out the pressurized air to pump or to inflate the tires or the like. The cylinder may not be used for drawing airs or the like. In addition, the pumps include a bad pumping effect such that the tire, particularly the vehicle tire may not be effectively pumped by the typical hand pumps.

The present invention has arisen to mitigate and/or obviate the afore-described disadvantages of the conventional pumps.

SUMMARY OF THE INVENTION

The primary objective of the present invention is to provide a pump including a port for drawing air or liquid or the other fluids.

The other objective of the present invention is to provide a pump including two or more actuators coupled together for facilitating the pump operation of the pump.

In accordance with one aspect of the invention, there is provided a pump comprising a first cylinder housing including a chamber formed therein, and including a first end having a mouth and a port provided therein, and including a second end, a piston slidably engaged in the chamber of the first cylinder housing for separating the chamber of the first cylinder housing into a first portion that is located closer to the mouth and the port and a second portion that is located away from the mouth and the port, the port of the first cylinder housing permitting a fluid to flow therethrough and to flow into the first portion of the chamber of the first cylinder housing when the piston moves away from the port, a tube coupled to the piston for allowing the fluid in the second portion of the chamber of the first cylinder housing to flow out through the tube when the piston moves away from the mouth and the port, a first check valve means for blocking the tube to prevent the fluid from flowing into of the first cylinder housing via the tube, and a second check valve means for blocking the port to prevent the fluid from flowing out of the first portion of the chamber of the first cylinder housing when the piston moves toward the port.

The piston includes a hollow duct extended therefrom, the tube includes a first end secured to the hollow duct and a second end extended outward of the first cylinder housing.

The piston includes a peripheral groove formed and defined between a first peripheral flange that is located closer to the mouth, and a second peripheral flange that is located away from the mouth, and a sealing ring received in the peripheral groove thereof, the first peripheral flange includes an inclined peripheral surface for forcing the sealing ring to engage with the first cylinder housing when the piston moves away from the mouth.

The second peripheral flange includes at least one aperture formed therein for allowing the fluid to flow through the second peripheral flange when the piston moves toward the mouth.

A cap is secured to the second end of the first cylinder housing, the cap includes a peripheral fence extended therein for forming and defining a peripheral channel therein and for receiving the second end of the first cylinder housing.

A base is further provided, the second end of the first cylinder housing is pivotally secured to the base, at least one arm includes a first end pivotally secured to the base and includes a middle portion coupled to the tube for moving the tube and the piston inward of the first cylinder housing with the arm.

A foot pedal is further provided and attached to the arm for rotating the arm relative to the base. A spring biasing means may further be provided for biasing the arm away from the first cylinder housing. A beam may further be provided and secured to the arm and includes a conduit secured to the tube.

The first check valve means includes a membrane secured to the conduit for selectively blocking the conduit when the piston moves away from the mouth.

A coupler is further provided and secured in the port of the first cylinder housing, the coupler includes a bore formed therein, the second check valve means includes a membrane secured to the coupler for selectively blocking the bore of the coupler when the piston moves toward the mouth.

A second cylinder housing is further provided and includes a chamber formed therein, and includes a first end having a mouth provided therein and coupled to the port of the first cylinder housing.

The second cylinder housing includes a port provided in the first end thereof, and a third check valve means for blocking the port of the second cylinder housing to prevent the fluid from flowing out through the port of the second cylinder housing.

The second cylinder housing includes a piston slidably engaged in the chamber thereof, a tube coupled to the piston for allowing a fluid in the chamber of the second cylinder housing to flow out through the tube when the piston moves away from the mouth of the second cylinder housing, and a third check valve means for blocking the tube to prevent the fluid from flowing into of the second cylinder housing via the tube.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figures 1, 2:
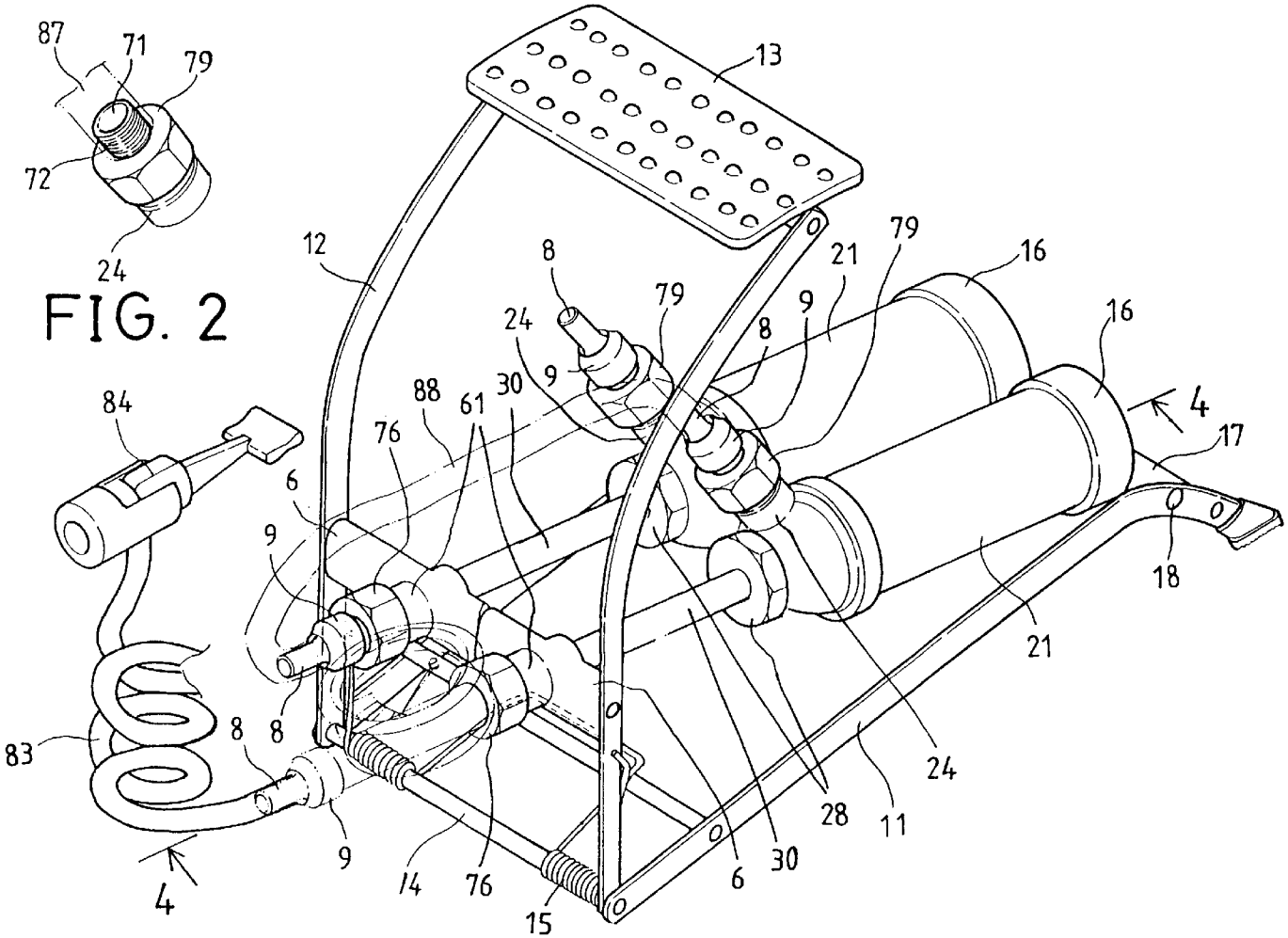
FIG. 1 is a perspective view of a pump in accordance with the present invention.
FIG. 2 is a partial perspective view of the pump.
Figure 3:
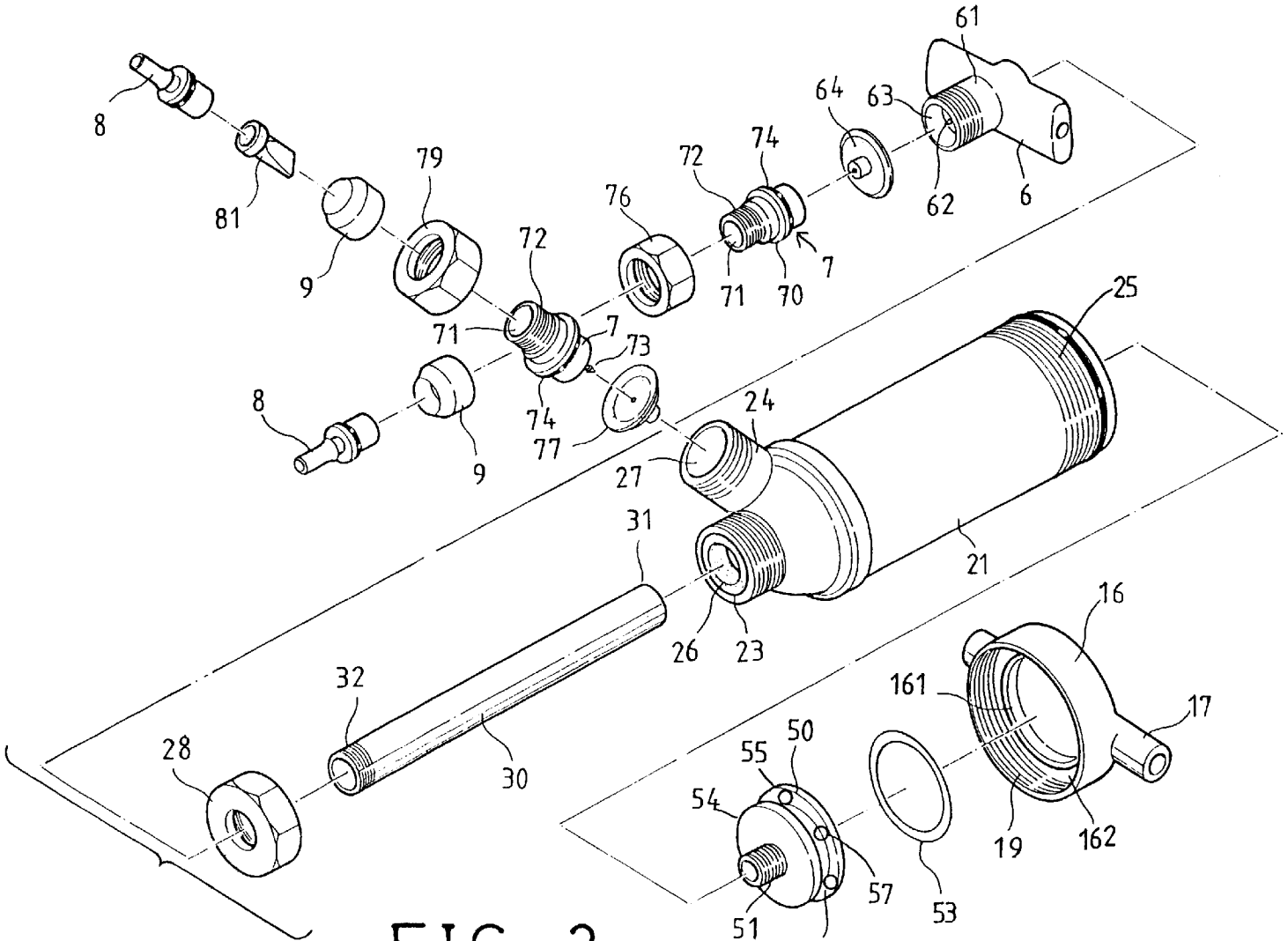
FIG. 3 is a partial exploded view of the pump.
Figure 4:
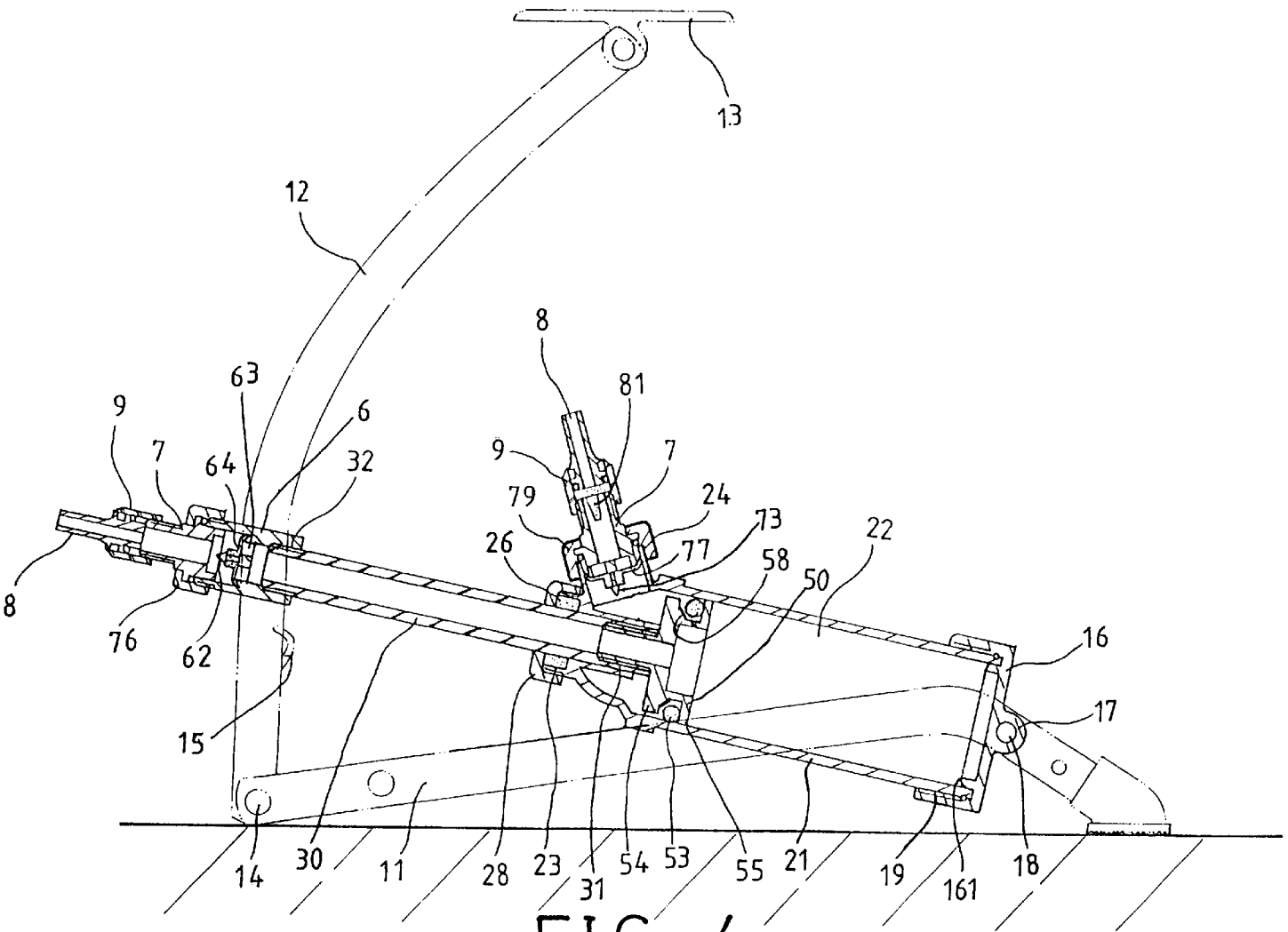
FIG. 4 is a cross sectional view taken along lines 4—4 of FIG. 1.

Referring to the drawings, and initially to FIGS. 1–4, a pump in accordance with the present invention comprises a base 11, and one or more arms 12 including a lower portion pivotally or rotatably secured to the base 11, such as to the front portion of the base 11 with a pivot axle 14 and including a foot pedal 13 secured on top thereof. A spring 15 is engaged on the axle 14 and engaged with the arms 12 for biasing the arms 12 upward or away from the base 11, to the position as shown in FIGS. 1 and 4. One or more caps 16 each includes a hub 17 pivotally or rotatably secured to the base 11 with a pivot shaft 18, and each includes an inner thread 19 formed therein, and each includes a peripheral fence 161 extended therein for forming or defining a peripheral or an annular channel 162 therein (FIG. 3). A beam 6 is secured to the arms 12 and preferably parallel to the axle 14.

One or more cylinder housings 21 each includes a chamber 22 formed therein, and each includes a mouth 23 and a port 24 formed or provided on one end, and each includes the other end engaged into the annular channel 162 of the caps 16 respectively. The cylinder housings 21 each includes an outer thread 25 formed or provided on the other end thereof for threading with the inner threads 19 of the caps 16 and for solidly securing the cylinder housings 21 to the caps 16 respectively, such that the caps 16 may be formed as an end cap for the respective cylinder housings 21. The mouth 23 and the port 24 each includes a bore 27 formed therein. A gasket 26 is engaged in the mouth 23.

Figure 5:
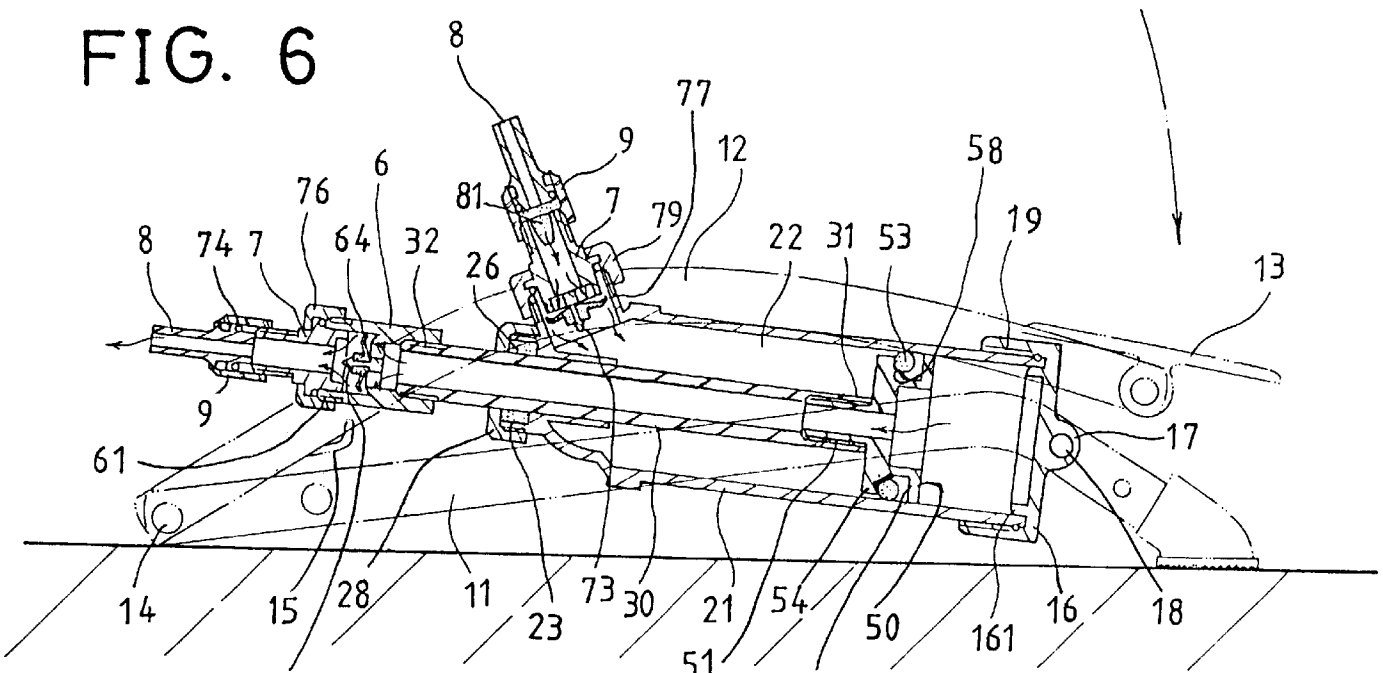
FIG. 5 is a cross sectional view similar to FIG. 4, illustrating the operation of the pump.

A piston 50 is slidably received in the chamber 22 of each of the cylinder housings 21 and includes a fastener or a hollow duct 51 extended therefrom for threading or securing to one end 31 of a tube 30. The piston 50 may separate the chamber 22 of the cylinder housing 21 into a front portion that is located closer to the mouth 23 and the port 24 and a rear portion that is located closer to the cap 16 or away from the mouth 23 and the port 24, and includes a peripheral groove 52 formed in the outer peripheral portion thereof and formed or defined by a pair of peripheral flanges 54, 55, for receiving a sealing ring 53 therein. The peripheral flange 54 has an outer diameter slightly smaller than the inner diameter of the cylinder housing 21, and has an inclined peripheral surface 58 (FIGS. 4, 5) for engaging with the sealing ring 53 and for forcing the sealing ring 53 to make an air tight or a water tight seal between the piston 50 and the cylinder housing 21 when the piston 50 is moved toward the cap 16 or moved away from the mouth 23 and the port 24 (FIG. 5). The other peripheral flange 55 includes one or more apertures 57 formed therein (FIG. 3) for allowing the air to flow bypass the piston 50 when the piston 50 is moved away from the cap 16 or moved toward the mouth 23 and the port 24 (FIG. 4).

As shown in FIGS. 4 and 5, the gasket 26 is engaged between the tube 30 and the mouth 23 for making an air tight or a water tight between the tube 30 and the mouth 23. A fastener or a cap or a nut 28 is threaded onto the mouth 23 for securing or retaining the gasket 26 in the mouth 23 and for maintaining the engagement of the gasket 26 between the tube 30 and the mouth 23.

The beam 6 includes one or more conduits 61 extended or formed therein. The conduits 61 each includes a bore 63 formed therein, and each includes a check valve 64, such as a membrane 64 secured thereto with a retainer 62, for selectively blocking the bore 63 of the conduit 61. A coupler 7 has one end engaged into each of the conduits 61 and has a peripheral flange 70 engaged with the conduit 61 with a sealing ring 74 and secured to the conduit 61 with a fastener 76. The coupler 7 includes an outer thread 72 formed on the other end thereof, and a bore 71 formed or provided therein for receiving a nozzle 8 which is secured to the coupler 7 with a fastener 9. The fastener 9 may be threaded with the outer thread 72 of the coupler 7 for stably retaining or retaining the nozzle 8 to the coupler 7. The check valve 64 allows the air or the fluid to flow out through the nozzle 8 (FIG. 5) and may be used to prevent the air or the fluid from flowing backward from the nozzle 8 into the conduits 61 (FIG. 4).

Another coupler 7 has one end engaged into the bore 27 of the port 24 and has a peripheral flange 70 engaged with the port 24 with a sealing ring 74 and secured to the port 24 with a fastener 79. The coupler 7 includes an outer thread 72 formed on the other end thereof, and a bore 71 formed or provided therein for receiving another nozzle 8 which is secured to the coupler 7 with a fastener 9. The fastener 9 may be threaded with the outer thread 72 of the coupler 7 for stably retaining or retaining the nozzle 8 to the coupler 7. A guide 81 may further be provided and engaged in the bore 71 of the coupler 7 for guiding the air or the fluid to flow out of the nozzle 8. Another check valve 77, such as a membrane 77 is secured to the coupler 7 with a retainer 73, for selectively blocking the bore 71 of the coupler 7. The check valve 77 allows the air or the fluid to flow into the port 24 from the nozzle 8 only (FIG. 5) and may be used to block the port 24 and to prevent the air or the fluid from flowing outward through the nozzle 8 (FIG. 4).

In operation, as shown in FIG. 4, the spring 15 may bias the arms 12 away from the cylinder housing 21, and thus may move the piston 50 toward the front end of the cylinder housing 21 or toward the mouth 23, and thus may force the tube 30 to move outward of the cylinder housing 21. When the arms 12 are moved or rotated or stepped downward toward the base 11 or toward the cylinder housing 21 by such as stepping the foot pedal 13, the beam 6 and the arms 12 may force the tube 30 and the piston 50 inward of the cylinder housing 21, as shown in FIG. 5, such that the air or the fluid in the chamber 22 of the cylinder housing 21 may be pressurized and forced to flow through the piston 50 and the tube 30 and the check valve 64 and then to flow out through the nozzle 8. As shown in FIG. 1, a nozzle or a valve 84 may be coupled to the nozzle 8 with a hose 83 or the like for allowing the pressurized air to flow out through the valve 84 in order to inflate the tire or the like.

Figure 6:
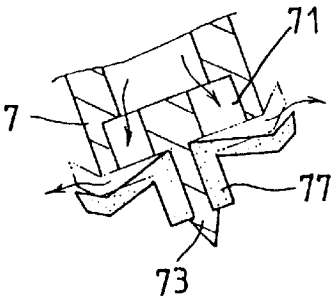
FIG. 6 is an enlarged partial cross sectional view illustrating the operation of the pump.

As also shown in FIG. 5, when the piston 50 is moved inward of the cylinder housing 21, or when the piston 50 is moved toward the cap 16 or moved away from the mouth 23 and the port 24, the inclined peripheral surface 58 (FIGS. 4, 5) of the piston 50 may force the sealing ring 53 to make an air tight or a water tight seal between the piston 50 and the cylinder housing 21, such that the air may be forced or drawn inward through the nozzle 8 and the port 24 via the check valve 77 (FIG. 6) and thus may be drawn into the chamber 22 of the cylinder housing 21 that is located in the front portion of the piston 50. As shown in FIG. 2, the coupler 7 may be coupled to an air reservoir, or a fluid or water reservoir with a hose 87 for allowing the air or the fluid to be drawn into the chamber 22 of the cylinder housing 21.

When the foot pedal 13 or the arms 12 are released, and/or when the spring 15 bias the arms 12 away from the cylinder housing 21, as shown in FIG. 4, the sealing ring 53 may be disengaged from the inclined peripheral surface 58 of the piston 50 and may be loosely received in the peripheral groove 52 of the piston 50, such that the air or the fluid may flow bypass the sealing ring 53 and may flow through the apertures 57 of the other peripheral flange 55 of the piston 50, and such that the air or the fluid may flow into the chamber 22 of the cylinder housing 20 that is located in the rear portion of the piston 50. The check valve 77 may prevent the air from being forced to flow out through the port 24 when the piston 50 is moved toward the port 24.

When the piston 50 is, again, forced to move inward the cylinder housing 21 or away from the mouth 23 and the port 24, as shown in FIG. 5, the air in the chamber 22 of the cylinder housing 21 that is located closer to the cap 16 may be pressurized and forced to flow out through the tube 30 and the nozzle 8 again, and the air or the fluid may be drawn again into the chamber 22 of the cylinder housing 21 that is located closer to the port 24 of the cylinder housing 21. The air or the fluid may thus be drawn into the chamber 22 of the cylinder housing 21 step by step and may thus be pumped out of the mouth 23 step by step in a reciprocating action.

Referring again to FIG. 1, one or more further cylinder housings 21 may be secured to the base 11 with the caps 16 and may also be secured to the beam 6. The nozzle 8 that is coupled to the mouth 23 of the other or the second cylinder housing 21 may be coupled to the nozzle 8 of the mouth 24 of the first cylinder housing 21. The air pumped out of the second cylinder housing 21 may thus be supplied into the first cylinder housing 21 via the port 23 of the first cylinder housing 21, such that the air may be pressurized by the second cylinder housing 21 before flowing into the first cylinder housing 21. The other additional cylinder housings 21 may also be used to provide the pressurized air toward the first cylinder housing 21, for allowing the vehicle tires to be quickly pumped or inflated by the pump of the present invention.

Accordingly, the pump in accordance with the present invention includes a port for drawing air or liquid or the other fluids, and includes two or more actuators selectively coupled together for facilitating the pump operation of the pump.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A pump comprising:

a first cylinder housing including a chamber formed therein, and including a first end having a mouth and a port provided therein, and including a second end, a piston slidably engaged in said chamber of said first cylinder housing for separating said chamber of said first cylinder housing into a first portion that is located closer to said mouth and said port and a second portion that is located away from said mouth and said port, said port of said first cylinder housing permitting a fluid to flow therethrough and to flow into said first portion of said chamber of said first cylinder housing when said piston moves away from said port, a tube coupled to said piston for allowing the fluid in said second portion of said chamber of said first cylinder housing to flow out through said tube when said piston moves away from said mouth and said port, a first check valve means for blocking said tube to prevent the fluid from flowing into of said first cylinder housing via said tube, and a second check valve means for blocking said port to prevent the fluid from flowing out of said first portion of said chamber of said first cylinder housing when said piston moves toward said port.

2. The pump according to claim 1, wherein said piston includes a hollow duct extended therefrom, said tube includes a first end secured to said hollow duct and a second end extended outward of said first cylinder housing.

3. The pump according to claim 1, wherein said piston includes a peripheral groove formed and defined between a first peripheral flange that is located closer to said mouth, and a second peripheral flange that is located away from said mouth, and includes a sealing ring received in said peripheral groove thereof, said first peripheral flange includes an inclined peripheral surface for engaging with said sealing ring and for forcing said sealing ring to engage with said first cylinder housing when said piston moves away from said mouth.

4. The pump according to claim 3, wherein said second peripheral flange includes at least one aperture formed therein for allowing the fluid to flow through said second peripheral flange when said piston moves toward said mouth.

5. The pump according to claim 1 further comprising a cap secured to said second end of said first cylinder housing, said cap including a peripheral fence extended therein for forming and defining a peripheral channel therein and for receiving said second end of said first cylinder housing.

6. The pump according to claim 5 further comprising a base, said cap being pivotally secured to said base with a pivot shaft, at least one arm including a first end pivotally secured to said base with a pivot axle and including a middle portion coupled to said tube for moving said tube and said piston inward of said first cylinder housing with said at least one arm.

7. The pump according to claim 6 further comprising a foot pedal attached to said at least one arm for rotating said at least one arm relative to said base.

8. The pump according to claim 6 further comprising means for biasing said at least one arm away from said first cylinder housing.

9. The pump according to claim 6 further comprising a beam secured to said at least one arm and including a conduit secured to said tube.

10. The pump according to claim 9, wherein said first check valve means includes a membrane secured to said conduit for selectively blocking said conduit when said piston moves away from said mouth.

11. The pump according to claim 1 further comprising a coupler secured in said port of said first cylinder housing, said coupler including a bore formed therein, said second check valve means includes a membrane secured to said coupler for selectively blocking said bore of said coupler when said piston moves toward said mouth.

12. The pump according to claim 1 further comprising a base, said second end of said first cylinder housing being pivotally secured to said base, at least one arm including a first end pivotally secured to said base and including a middle portion coupled to said tube for moving said tube and said piston inward of said first cylinder housing with said at least one arm.

13. The pump according to claim 12 further comprising a foot pedal attached to said at least one arm for rotating said at least one arm relative to said base.

14. The pump according to claim 12 further comprising means for biasing said at least one arm away from said first cylinder housing.

15. The pump according to claim 12 further comprising a beam secured to said at least one arm and including a conduit secured to said tube.

16. The pump according to claim 15, wherein said first check valve means includes a membrane secured to said conduit for selectively blocking said conduit when said piston moves away from said mouth.

17. The pump according to claim 1 further comprising a second cylinder housing including a chamber formed therein, and including a first end having a mouth provided therein and coupled to said port of said first cylinder housing.

18. The pump according to claim 17, wherein said second cylinder housing includes a port provided in said first end thereof, and a third check valve means for blocking said port of said second cylinder housing to prevent the fluid from flowing out through said port of said second cylinder housing.

19. The pump according to claim 17, wherein said second cylinder housing includes a piston slidably engaged in said chamber thereof, a tube coupled to said piston for allowing a fluid in said chamber of said second cylinder housing to flow out through said tube when said piston moves away from said mouth of said second cylinder housing, and a third check valve means for blocking said tube to prevent the fluid from flowing into of said second cylinder housing via said tube.

* * * * *